US010422278B2

(12) United States Patent
Marroquin et al.

(10) Patent No.: US 10,422,278 B2
(45) Date of Patent: Sep. 24, 2019

(54) PRESSURE SENSOR CLEANING DEVICE

(71) Applicant: Progress Rail Locomotive Inc., LaGrange, IL (US)

(72) Inventors: Juan Carlos Marroquin, Lisle, IL (US); Jaldeep Niranjan Kansara, Bolingbrook, IL (US); Arvindkumar Makasana, Naperville, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 187 days.

(21) Appl. No.: 15/706,153

(22) Filed: Sep. 15, 2017

(65) Prior Publication Data

US 2019/0085764 A1 Mar. 21, 2019

(51) Int. Cl.

| | |
|---|---|
| ***F02M 26/00*** | (2016.01) |
| ***F02B 77/04*** | (2006.01) |
| ***B08B 5/02*** | (2006.01) |
| ***F02M 26/47*** | (2016.01) |

(52) U.S. Cl.

CPC ..... *F02B 77/04* (2013.01); *B08B 5/02* (2013.01); *F02M 26/47* (2016.02)

(58) Field of Classification Search

CPC ..... F02M 26/47; F02B 77/04; B08B 5/02
See application file for complete search history.

(56) References Cited

U.S. PATENT DOCUMENTS

| | | | | |
|---|---|---|---|---|
| 3,887,907 | A * | 6/1975 | Brill | E02B 15/04 73/61.59 |
| 6,561,036 | B1 * | 5/2003 | Gustafsson | G01L 9/0026 73/114.18 |
| 8,273,185 | B2 * | 9/2012 | Milles | B01D 41/04 134/10 |
| 9,550,217 | B2 * | 1/2017 | Wieland | B01D 41/04 |
| 2016/0202229 | A1 | 7/2016 | Xiong et al. | |
| 2018/0236386 | A1 * | 8/2018 | Bauer | B01D 46/0019 |

FOREIGN PATENT DOCUMENTS

| | | |
|---|---|---|
| CN | 203455060 | 2/2014 |
| DE | 3604385 | 10/1994 |
| DE | 102007016099 | 10/2008 |
| JP | H0429848 | 5/1992 |
| JP | 2853393 | 2/1999 |
| KR | 20160079303 | 7/2016 |

* cited by examiner

*Primary Examiner* — Thomas N Moulis

(57) ABSTRACT

A cleaning device for a pressure sensor associated with an engine system includes a one-way valve having an inlet side and an outlet side. The outlet side is in selective fluid communication with an inlet of the pressure sensor. The cleaning device also includes a compressed air source in selective fluid communication with the one-way valve. The cleaning device further includes a control module communicably coupled to each of the pressure sensor, the one-way valve, and the compressed air source. The control module is configured to control an operation of the one-way valve and the compressed air source to impart at least one of a long burst of modulated air and a short burst of modulated air on the inlet of the pressure sensor.

20 Claims, 4 Drawing Sheets

PRESSURE SENSOR CLEANING DEVICE

TECHNICAL FIELD

The present disclosure relates to a cleaning device for a pressure sensor associated with an engine system.

BACKGROUND

Engine systems, such as diesel engine systems, include pressure sensors that are associated with various components of the engine systems. For example, the pressure sensor may be associated with an Exhaust Gas Recirculation (EGR) system or an aftertreatment system of the engine system. In an example where the pressure sensor is associated with the EGR system, re-circulated exhaust gases contact an inlet of the pressure sensor. A byproduct of the re-circulated exhaust gases is soot, and over a period of time the soot in the re-circulated exhaust gases gets deposited on the inlet of the pressure sensor. The soot deposits affect a measuring accuracy of the pressure sensor causing the sensor to give faulty pressure readings, which is not desirable.

In another example, where the pressure sensor is associated with the aftertreatment system, exhaust gases flowing through the aftertreatment system may contact the inlet of the pressure sensor. The exhaust gases may also include soot or other byproducts that may deposit and affect the measuring accuracy of the pressure sensors.

CN Utility Model 203455060 describes a sealed electronic belt scale equipped with a compressed air ash-cleaning device. The sealed electronic belt scale comprises an electronic belt scale housing, a pressure sensor installing platform, and a pressure sensor. The pressure sensor installing platform and the pressure sensor are hermetically installed inside the electronic belt scale housing. A compressed air ash-cleaning pipeline is disposed on the electronic belt scale housing. The sealing electronic belt scale has an advantage that ash on the pressure sensor installing platform is cleaned regularly by using the compressed air ash-cleaning pipeline so as to achieve effects of guaranteeing the measuring accuracy of the sensor, enabling stable operation of production safety, and eliminating potential safety hazards.

SUMMARY OF THE DISCLOSURE

In one aspect of the present disclosure, a cleaning device for a pressure sensor associated with an engine system is provided. The cleaning device includes a one-way valve having an inlet side and an outlet side. The outlet side is in selective fluid communication with an inlet of the pressure sensor. The cleaning device also includes a compressed air source in selective fluid communication with the one-way valve. The cleaning device further includes a control module communicably coupled to each of the pressure sensor, the one-way valve, and the compressed air source. The control module is configured to control an operation of the one-way valve and the compressed air source to impart at least one of a long burst of modulated air and a short burst of modulated air on the inlet of the pressure sensor.

In another aspect of the present disclosure, a method for cleaning a pressure sensor associated with an engine system is provided. The method includes providing a one-way valve in selective fluid communication with the pressure sensor such that an outlet side of the one-way valve faces an inlet of the pressure sensor. The method also includes providing a compressed air source in selective fluid communication with the one-way valve. The method further includes controlling, by a control module, an operation of the one-way valve and the compressed air source to impart at least one of a long burst of modulated air and a short burst of modulated air on the inlet of the pressure sensor.

In yet another aspect of the present disclosure, an engine system is provided. The engine system includes an engine and an exhaust system. The engine system also includes a pressure sensor associated with at least one of the engine and the exhaust system. The engine system further includes a cleaning device for cleaning the pressure sensor. The cleaning device includes a one-way valve having an inlet side and an outlet side. The outlet side is in selective fluid communication with an inlet of the pressure sensor. The cleaning device also includes a compressed air source in selective fluid communication with the one-way valve. The cleaning device further includes a control module communicably coupled to each of the pressure sensor, the one-way valve, and the compressed air source. The control module is configured to control an operation of the one-way valve and the compressed air source to impart at least one of a long burst of modulated air and a short burst of modulated air on the inlet of the pressure sensor.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
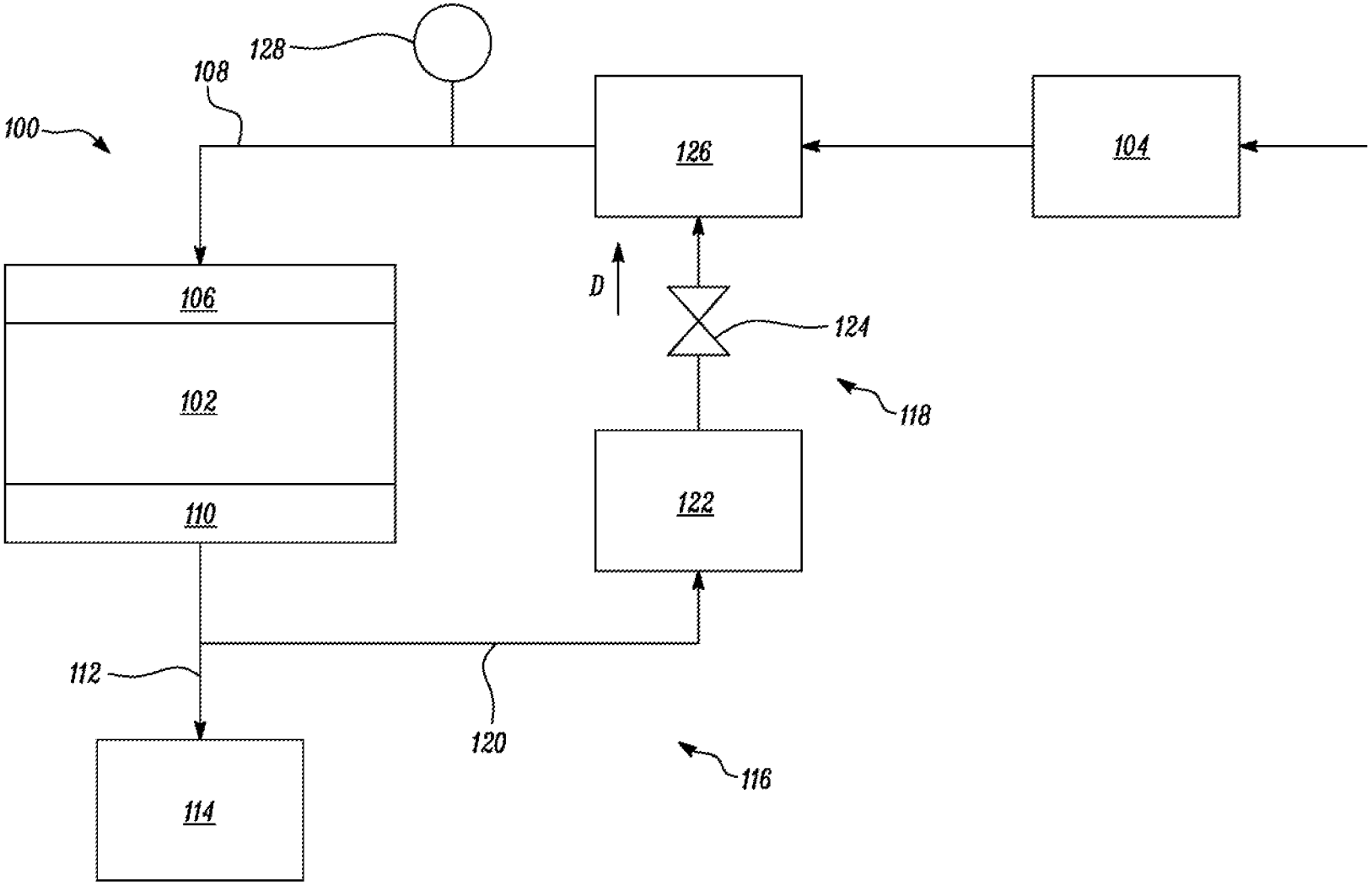
FIG. 1 is a schematic view of an exemplary engine system, according to one embodiment of the present disclosure.

FIG. 1 is a schematic view of an exemplary engine system 100. The engine system 100 includes an engine 102. The engine 102 may be an internal combustion engine, such as a reciprocating piston engine. Further, the engine 102 may be a spark ignition engine or a compression ignition engine, such as a diesel engine, a homogeneous charge compression ignition engine, a reactivity controlled compression ignition engine, or any other compression ignition engine known in the art. The engine 102 may be fueled by one or a combination of gasoline, diesel fuel, biodiesel, dimethyl ether, alcohol, natural gas, propane, or any other combustion fuel known in the art.

The engine 102 may be used to power a machine (not shown) including, but not limited to, a locomotive, an on-highway truck, an off-highway truck, a loader, an electric generator, and the like. Further, the engine system 100 may be associated with an industry including, but not limited to, transportation, mining, construction, agriculture, forestry, power generation, and material handling. The engine 102 includes an air intake system 104. The air intake system 104 introduces fresh air in the engine 102 for an operation thereof. The air intake system 104 may include various components (not shown), such as, an air cooler, an air filter, and the like. The air intake system 104 is coupled to an intake manifold 106 of the engine 102 via an intake conduit 108.

The engine 102 also includes an exhaust manifold 110. Further, an exhaust conduit 112 receives exhaust gases from the exhaust manifold 110. The exhaust conduit 112 fluidly couples the exhaust manifold 110 with an aftertreatment system 114. The aftertreatment system 114 forms a part of an exhaust system 116 of the engine system 100. The aftertreatment system 114 treats exhaust gases exiting the exhaust manifold 110 of the engine 102. The exhaust gases contain emission compounds that may include nitrogen oxides (NOx), unburned hydrocarbons, particulate matter, and other such combustion products. The aftertreatment system 114 may trap or convert NOx, unburned hydrocarbons, particulate matter, its combinations, or other combustion products in the exhaust gases before exiting the engine system 100. The aftertreatment system 114 may include various components (not shown), such as, a Diesel Particulate Filter (DPF), a Diesel Oxidation catalyst (DOC), a Selective Catalytic Reduction (SCR) module, and the like, without any limitations.

Further, the exhaust system 116 also includes an Exhaust Gas Recirculation (EGR) system 118. An EGR conduit 120 branching from the exhaust conduit 112 couples the exhaust conduit 112 with the EGR system 118 for recirculating and introducing a portion of the exhaust gases in the intake conduit 108. The EGR system 118 includes an EGR cooler 122. The EGR cooler 122 lowers a temperature of the portion of the exhaust gases that are re-circulated by the EGR system 118.

Further, an EGR valve 124 is disposed downstream of the EGR cooler 122 with respect to a flow direction "D" of the re-circulated exhaust gases. The EGR valve 124 meters an amount of the re-circulated exhaust gases introduced in the intake conduit 108 based on engine load conditions. The re-circulated exhaust gases are then introduced in an EGR mixer 126 for mixing with the fresh air coming from the air intake system 104. The EGR mixer 126 is disposed along the intake conduit 108. A mixture of the re-circulated exhaust gases and the fresh air is sent to a compressor (not shown) where the mixture is compressed to a required pressure. The mixture of the fresh air/re-circulated exhaust gases may then enter the intake manifold 106, via the intake conduit 108.

The engine system 100 also includes a pressure sensor 128. The pressure sensor 128 may be associated with the engine 102 or the exhaust system 116. In one example, the pressure sensor 128 is associated with the EGR system 118. The pressure sensor 128 is disposed along the intake conduit 108 and downstream of the EGR mixer 126, such that the mixture of the fresh air and the re-circulated exhaust gases contact the pre pressure sensor 128. The pressure sensor 128 may embody any one of a capacitive pressure sensor and an electromagnetic pressure sensor, without any limitations. The pressure sensor 128 includes an inlet 130 having an inlet tip 132 that protrudes within the intake conduit 108. Further, the pressure sensor 128 also includes a pressure sensing element (not shown) positioned proximal to the inlet 130 of the pressure sensor 128, and within a body of the pressure sensor 128. In one example, the pressure sensing element may embody a diaphragm, without any limitations.

The pressure sensor 128 is exposed to soot that is present in the re-circulated exhaust gases. The soot gets deposited on the inlet tip 132 and the pressure sensing element, and may affect an accuracy of the pressure sensor 128. The present disclosure is directed towards a cleaning device 136 for cleaning the pressure sensor 128 of any soot or other deposits that may be present on the pressure sensor 128. More particularly, the cleaning device 136 is used to clean the inlet tip 132 and the pressure sensing element of the pressure sensor 128.

Although the present disclosure is explained in relation to the cleaning of the pressure sensor 128 that is disposed just downstream of the EGR mixer 126, it should be noted that the cleaning device 136 may be used for cleaning any other pressure sensor associated with any component of the exhaust system 116 or the engine 102. For example, the cleaning device 136 may be used to clean the pressure sensor associated with the aftertreatment system 114, and more particularly, the pressure sensor that is disposed proximate to the DPF, the DOC, or the SCR module of the aftertreatment system 114, without limiting the scope of the present disclosure.

Figure 2:
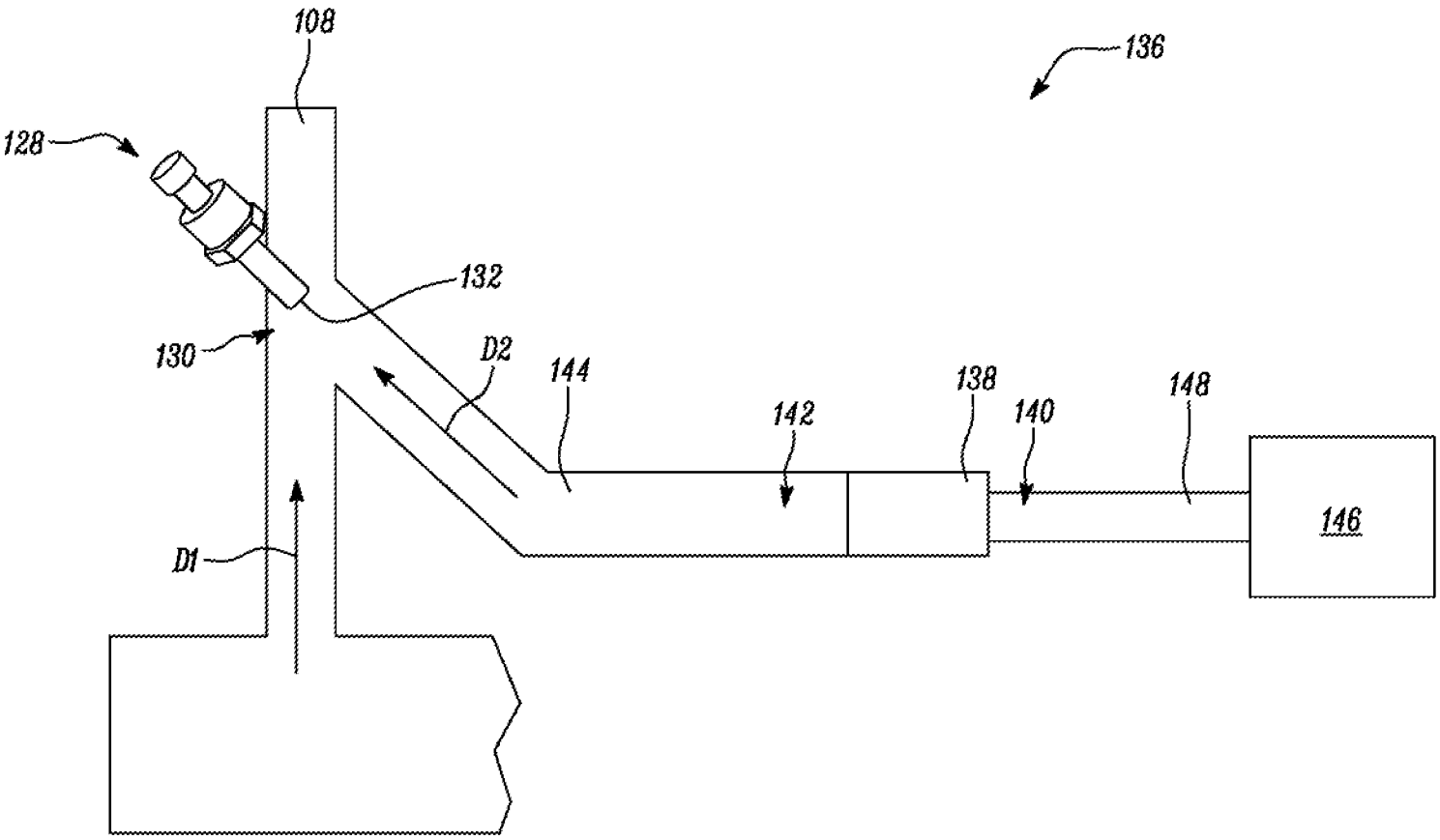
FIG. 2 is a schematic view of a cleaning device for a pressure sensor associated with the engine system shown in FIG. 1.

Referring to FIG. 2, a schematic view of the cleaning device 136 is illustrated. A flow path "D1" of the mixture of the fresh air and the re-circulated exhaust gases is illustrated in the accompanying figure. It should be noted that a set-up of the cleaning device 136 illustrated in FIG. 2 is exemplary in nature and the set-up may vary, without limiting the scope of the present disclosure. The cleaning device 136 includes a one-way valve 138 that is in selective fluid communication with the pressure sensor 128. In one example, the one-way valve 138 is embodied as a check valve. It should be noted that the one-way valve 138 may embody any known in the art unidirectional valve that allows flow of a fluid in one direction, and restricts a return flow of the fluid.

The one-way valve 138 includes an inlet side 140 and an outlet side 142. The outlet side 142 of the one-way valve 138 faces the inlet 130 of the pressure sensor 128. In an open position of the one-way valve 138, the outlet side 142 of the one-way valve 138 is in fluid communication with the inlet 130 of the pressure sensor 128. The one-way valve 138 is in selective fluid communication with the pressure sensor 128 via a fluid line 144. The fluid line 144 is provided at an angle with respect to the inlet 130 of the pressure sensor 128 in order to impart compressed air towards the inlet 130 at a desired angle, without any limitations.

Further, the cleaning device 136 includes a compressed air source 146. The compressed air source 146 is in selective fluid communication with the one-way valve 138. When the one-way valve 138 is in the open position, the one-way valve 138 provides fluid communication between the compressed air source 146 and the inlet 130 of the pressure sensor 128, via the fluid line 144. The compressed air source 146 is used to store the compressed air at a desired pressure. The compressed air stored in the compressed air source 146 is used to clean the pressure sensor 128, and more particularly, the inlet tip 132 and the pressure sensing element of the pressure sensor 128 based on the opening of the one-way valve 138 and the compressed air source 146.

In one example, the compressed air source 146 may embody a tank that stores the compressed air at a desired pressure. Further, the compressed air source 146 may be present on-board the machine on which the engine system 100 is mounted or the compressed air source 146 may be an externally mounted source of compressed air, without any limitations. In one example, the compressed air source 146 may be coupled with the one-way valve 138 via a pipe 148.

Figure 3:
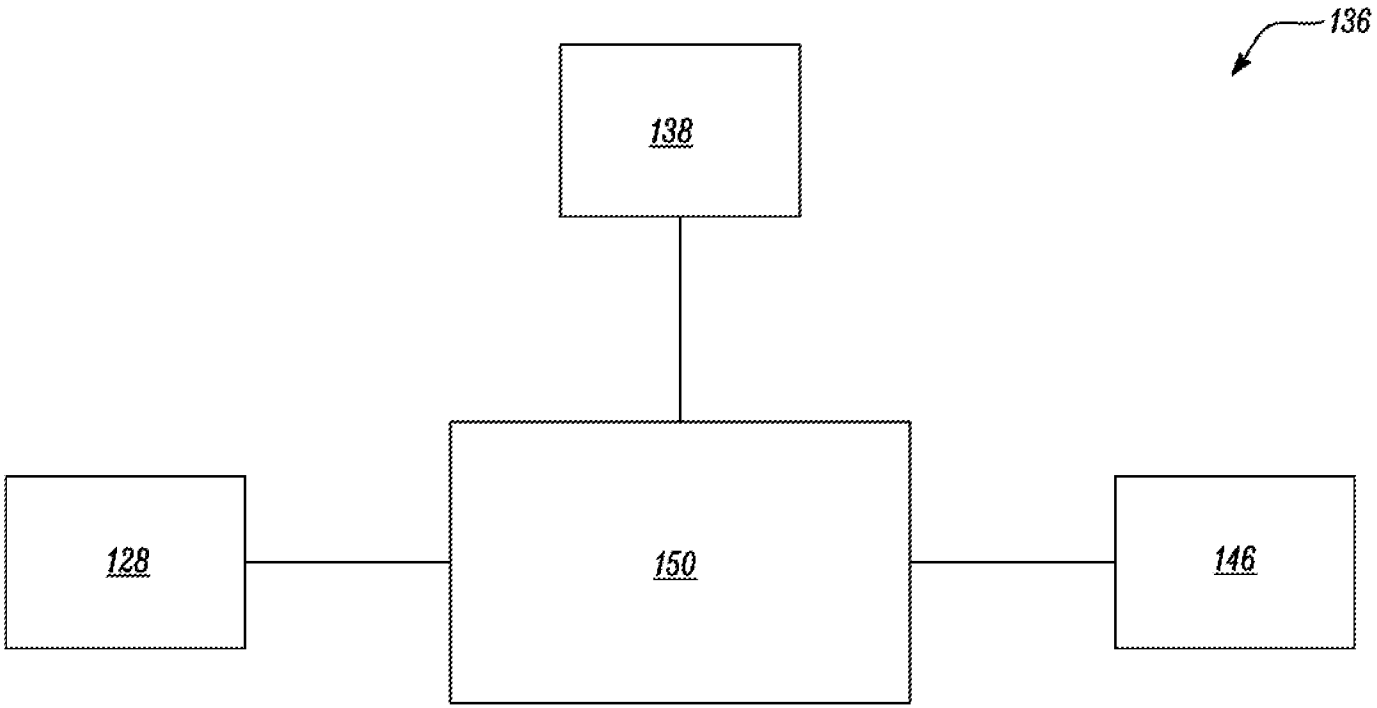
FIG. 3 is a block diagram view of the cleaning device.

As shown in FIG. 3, the cleaning device 136 also includes a control module 150. The control module 150 may embody a stand-alone device. Alternatively, an Engine Control Unit (ECU) associated with the engine system 100 or an Electronic Control module (ECM) associated with the machine on which the engine system 100 (see FIG. 1) is mounted may be programmed to perform operations of the control module 150, without any limitations. The control module 150 is communicably coupled to each of the pressure sensor 128, the one-way valve 138, and the compressed air source 146. Further, the control module 150 is capable of sending and receiving signals from each of the pressure sensor 128, the one-way valve 138, and the compressed air source 146.

The control module 150 controls an operation of the one-way valve 138 and the compressed air source 146. More particularly, the control module 150 sends signals for opening and closing the one-way valve 138 and the compressed air source 146. During a cleaning cycle of the pressure sensor 128, the control module 150 sends signals to the one-way valve 138 and the compressed air source 146 to open and impart a long burst of modulated air and a short burst of modulated air towards the pressure sensor 128. The long and short bursts of modulated air travel along a flow path "D2" towards the inlet 130. The long and short bursts of modulated air allow cleaning of the inlet tip 132 and the pressure sensing element of the pressure sensor 128.

In one example, the control module 150 controls the one-way valve 138 and the compressed air source 146 to alternatively impart the long and short bursts of modulated air for cleaning the pressure sensor 128. In another example, a pattern followed by the control module 150 to impart the long and short bursts of modulated air may vary, without any limitations. Further, duration and pressure of each of the long and short bursts of modulated air may be varied based on system requirements, without limiting the scope of the present disclosure. In one example, the duration and the pressure of each of the long and short bursts of modulated air is dependent on specifications of the pressure sensor 128, and more particularly on an allowable burst pressure that can be sustained by the pressure sensor 128 without damaging the pressure sensor 128.

In one example, the control module 150 imparts the long and short bursts of modulated air based on a feedback received from the pressure sensor 128. More particularly, based on pressure readings received by the control module 150 from the pressure sensor 128, the control module 150 imparts the long and short bursts of modulated air for cleaning of the pressure sensor 128. For example, if the pressure readings exceed a pre-determined limit, the long and short bursts of modulated air may be imparted until the pressure readings from the pressure sensor 128 lies within the pre-determined limit. The pre-determined limit may be decided based on a nominal pressure reading of the pressure sensor 128.

Further, in one example, the cleaning of the pressure sensor 128 may be performed after the engine system 100 is shut down or after the machine on which the engine system 100 is mounted has completed a particular work operation or a work shift. In such an example, the control module 150 may control the one-way valve 138 and the compressed air source 146 to perform the cleaning of the pressure sensor 128 till the pressure readings from the pressure sensor 128 approaches a barometric pressure.

Alternatively, the cleaning of the pressure sensor 128 may be performed in between the work operation or the work shift if the control module 150 detects that the pressure readings from the pressure sensor 128 exceeds the pre-determined limit. Further, the cleaning of the pressure sensor 128 may be performed at regular time intervals. For example, the cleaning of the pressure sensor 128 may be performed after the engine system 100 has exceeded a predefined number of engine operating hours, without any limitations.

The control module 150 may embody a single microprocessor or multiple microprocessors for receiving signals from components of the engine system 100. Numerous commercially available microprocessors may be configured to perform the functions of the control module 150. It should be appreciated that the control module 150 may embody a machine microprocessor capable of controlling numerous machine functions. A person of ordinary skill in the art will appreciate that the control module 150 may additionally include other components and may also perform other functions not described herein.

INDUSTRIAL APPLICABILITY

The present disclosure relates to the cleaning device 136 for the pressure sensor 128. The cleaning device 136 provides a simple and cost effective solution for cleaning various pressure sensors associated with different components of the engine system 100. Also, the cleaning device 136 includes fewer components, and can be easily operated by maintenance personnel. Periodic cleaning of the pressure sensor 128 using the cleaning device 136 disclosed herein will help in increasing an operating life of the pressure sensor 128 and also prevent sensor failure due to soot build up.

Further, based on the pressure readings from the pressure sensor 128, the maintenance personnel can immediately perform the cleaning of the pressure sensor 128 before the soot accumulated on the pressure sensor 128 can have a detrimental effect on the performance of the pressure sensor 128. Thus, the cleaning device 136 allows dynamic tracking and cleaning of the pressure sensor 128.

Figure 4:
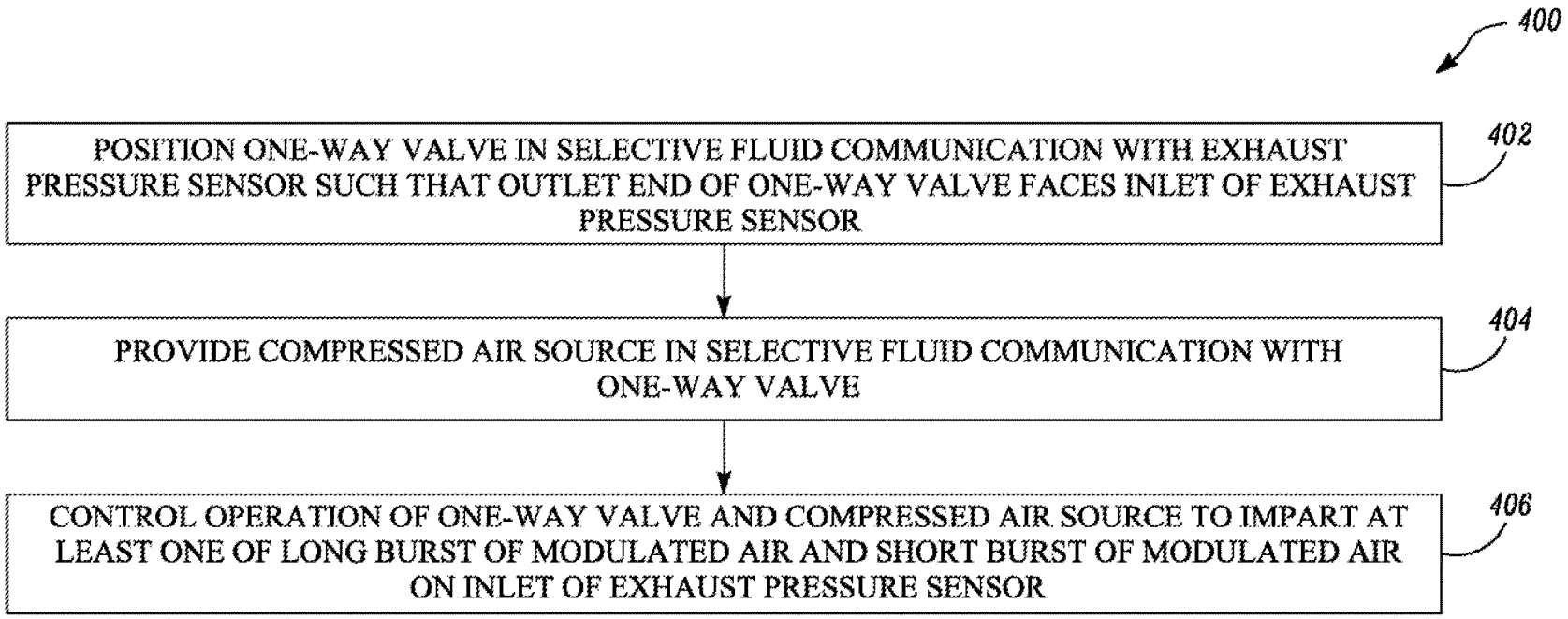
FIG. 4 is a flowchart for a method of cleaning the pressure sensor.

FIG. 4 is a flowchart for a method 400 of cleaning the pressure sensor 128. More particularly, the method 400 allows cleaning of the inlet tip 132 and the pressure sensing element of the pressure sensor 128. The pressure sensor 128 may be associated with the exhaust system 116 of the engine system 100. More particularly, the pressure sensor 128 may be associated with the EGR system 118.

At step 402, the one-way valve 138 is provided in selective fluid communication with the pressure sensor 128 such that the outlet side 142 of the one-way valve 138 faces the inlet 130 of the pressure sensor 128. The one-way valve 138 is embodied as a check valve. At step 404, the compressed air source 146 is provided in selective fluid communication with the one-way valve 138.

At step 406, the control module 150 controls the operation of the one-way valve 138 and the compressed air source 146 to impart the long burst of modulated air and the short burst of modulated air on the inlet 130 of the pressure sensor 128. The long and short bursts of modulated air are imparted based on the feedback received from the pressure sensor 128. More particularly, the long and short bursts of modulated air are imparted until the pressure readings from the pressure sensor 128 are within the pre-determined limit.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A cleaning device for a pressure sensor associated with an engine system, the cleaning device comprising:

a one-way valve having an inlet side and an outlet side, wherein the outlet side is in selective fluid communication with an inlet of the pressure sensor;

a compressed air source in selective fluid communication with the one-way valve; and a control module communicably coupled to each of the pressure sensor, the one-way valve, and the compressed air source, wherein the control module is configured to control an operation of the one-way valve and the compressed air source to impart at least one of a long burst of modulated air and a short burst of modulated air on the inlet of the pressure sensor.

2. The cleaning device of claim 1, wherein the control module is configured to impart the least one of the long burst of modulated air and the short burst of modulated air based on a feedback received from the pressure sensor.

3. The cleaning device of claim 2, wherein the control module is configured to impart the least one of the long burst of modulated air and the short burst of modulated air until pressure readings from the pressure sensor are within pre-determined limits.

4. The cleaning device of claim 1, wherein the pressure sensor is associated with an exhaust system of the engine system.

5. The cleaning device of claim 4, wherein the pressure sensor is associated with an Exhaust Gas Recirculation (EGR) system.

6. The cleaning device of claim 1, wherein the cleaning device is adapted to clean an inlet tip and a pressure sensing element of the pressure sensor.

7. The cleaning device of claim 1, wherein the one-way valve is embodied as a check valve.

8. A method for cleaning a pressure sensor associated with an engine system, the method comprising:

providing a one-way valve in selective fluid communication with the pressure sensor such that an outlet side of the one-way valve faces an inlet of the pressure sensor;

providing a compressed air source in selective fluid communication with the one-way valve; and controlling, by a control module, an operation of the one-way valve and the compressed air source to impart at least one of a long burst of modulated air and a short burst of modulated air on the inlet of the pressure sensor.

9. The method of claim 8 further including imparting the least one of the long burst of modulated air and the short burst of modulated air based on a feedback received from the pressure sensor.

10. The method of claim 9 further including imparting the least one of the long burst of modulated air and the short burst of modulated air until pressure readings from the pressure sensor are within pre-determined limits.

11. The method of claim 8, wherein the pressure sensor is associated with an exhaust system of the engine system.

12. The method of claim 11, wherein the pressure sensor is associated with an Exhaust Gas Recirculation (EGR) system.

13. The method of claim 8 further including cleaning an inlet tip and a pressure sensing element of the pressure sensor.

14. The method of claim 8, wherein the one-way valve is embodied as a check valve.

15. An engine system comprising:

an engine;

an exhaust system;

a pressure sensor associated with at least one of the engine and the exhaust system; and a cleaning device for cleaning the pressure sensor, the cleaning device comprising:

a one-way valve having an inlet side and an outlet side, wherein the outlet side is in selective fluid communication with an inlet of the pressure sensor, a compressed air source in selective fluid communication with the one-way valve; and a control module communicably coupled to each of the pressure sensor, the one-way valve, and the compressed air source, wherein the control module is configured to control an operation of the one-way valve and the compressed air source to impart at least one of a long burst of modulated air and a short burst of modulated air on the inlet of the pressure sensor.

16. The engine system of claim 15, wherein the control module is configured to impart the least one of the long burst of modulated air and the short burst of modulated air based on a feedback received from the pressure sensor.

17. The engine system of claim 16, wherein the control module is configured to impart the least one of the long burst of modulated air and the short burst of modulated air until pressure readings from the pressure sensor are within pre-determined limits.

18. The engine system of claim 15, wherein the pressure sensor is associated with an Exhaust Gas Recirculation (EGR) system.

19. The engine system of claim 15, wherein the cleaning device is adapted to clean an inlet tip and a pressure sensing element of the pressure sensor.

20. The engine system of claim 15, wherein the one-way valve is embodied as a check valve.

* * * * *